US007624460B2

(12) United States Patent
Maimone et al.

(10) Patent No.: US 7,624,460 B2
(45) Date of Patent: Dec. 1, 2009

(54) COMFORTER COVER AND COMFORTER

(76) Inventors: Michael J. Maimone, 100-121 Baker Ct., Island Park, NY (US) 11558; Jaydine M. Jimenez, 100-121 Baker Ct., Island Park, NY (US) 11558

( * ) Notice: Subject to any disclaimer, the term of this patent is extended or adjusted under 35 U.S.C. 154(b) by 0 days.

(21) Appl. No.: 11/942,871

(22) Filed: Nov. 20, 2007

(65) Prior Publication Data

US 2009/0126111 A1 May 21, 2009

(51) Int. Cl.
*A47G 9/02* (2006.01)

(52) U.S. Cl. ..... 5/501; 5/502; 5/485

(58) Field of Classification Search ..... 5/501, 5/502, 485, 486, 499, 738
See application file for complete search history.

(56) References Cited

U.S. PATENT DOCUMENTS

| | | | | | |
|---|---|---|---|---|---|
| 708,109 | A | | 9/1902 | Williams | |
| 1,009,332 | A | | 11/1911 | Mead | |
| 1,118,220 | A | | 11/1914 | Oplustil | |
| 1,261,314 | A | | 4/1918 | Stoddard | |
| 1,347,642 | A | | 7/1920 | McNatt | |
| 1,577,226 | A | | 3/1926 | Greenberg | |
| 2,066,252 | A | * | 12/1936 | Cohen, Jr. | 5/499 |
| 2,179,175 | A | * | 11/1939 | Cohen, Jr. | 5/499 |
| 2,183,360 | A | | 12/1939 | Sussman | |
| 2,262,436 | A | * | 11/1941 | Cotton | 5/501 |
| 2,505,027 | A | | 4/1950 | Belsky | |
| 2,737,667 | A | | 3/1956 | Picon | |
| 2,810,921 | A | * | 10/1957 | Seidenberg | 5/501 |
| 2,821,723 | A | | 2/1958 | Gluck | |
| 3,008,152 | A | | 11/1961 | Seidenberg | |
| 3,241,161 | A | * | 3/1966 | Dashosh | 5/501 |
| 3,340,549 | A | * | 9/1967 | Billerbeck | 5/502 |
| 4,573,227 | A | | 3/1986 | Prandina | |
| 4,903,361 | A | | 2/1990 | Tang | |
| 5,243,725 | A | | 9/1993 | Fowler | |
| 5,836,023 | A | * | 11/1998 | Stone Munson | 5/482 |
| 6,637,054 | B2 | | 10/2003 | Chuang | |
| 6,971,128 | B1 | * | 12/2005 | McGrath | 5/490 |
| 7,013,509 | B2 | | 3/2006 | Hickman | |
| 7,111,345 | B1 | | 9/2006 | Hui | |
| 7,181,790 | B2 | | 2/2007 | Wirtz | |
| 7,228,578 | B2 | | 6/2007 | Linnane | |
| 2007/0000053 | A1 | | 1/2007 | Yang | |

* cited by examiner

*Primary Examiner*—Michael Trettel
(74) *Attorney, Agent, or Firm*—Greenberg Traurig, LLP

(57) ABSTRACT

Disclosed is a comforter cover having a sleeve and one or more end caps. The sleeve can have one or two open ends and the comforter can be received into the sleeve through one of the open ends. The end cap or end caps can be fittable over the sleeve and comforter to close the open end or ends of the sleeve. A fastening system can fasten the end cap or end caps to the sleeve. The fastening system can be provided by buttons attached to the comforter which button through buttonholes in the sleeve and end caps, or by closable fasteners passing through openings in the sleeve, the end caps and also in the comforter, or other suitable fastening devices. The comforter cover can protect the comforter against wear and tear, promotes cleanliness, can seal in an esthetic manner and lends itself to a variety of ornamentation and visual effects.

22 Claims, 4 Drawing Sheets

COMFORTER COVER AND COMFORTER

STATEMENT REGARDING FEDERALLY SPONSORED RESEARCH OR DEVELOPMENT (Not Applicable.)

The present invention relates to a comforter cover for protecting a comforter and to the combination of the comforter cover with the comforter. More particularly, the invention relates to a comforter cover which can cover and protect a comforter and which, if desired, can ornament or decorate the comforter.

BACKGROUND OF THE INVENTION

Comforter covers are often used to keep a comforter clean and protect it. By changing the cover, users can change the outer appearance such as the fabric, pattern, and color of a comforter as desired. Prior to the present invention, comforter covers generally have taken the form of a rectangular fabric sack, having an opening on one side through which the comforter can be inserted into the cover. This open side is then closed by means such as buttons, snaps or snap fasteners, or other closure devices.

A problem not generally addressed by known designs of comforter cover is that the ends of the cover are prone to wear, for example as a result of scuffing by the floor and otherwise during normal use. Also, typical known comforter covers employ rudimentary buttoning, or other fasteners, along the edge or edges of the open sides of the covers which can let dirt into the cover between the fasteners. In addition, with many known comforter covers, the comforter may be difficult to insert or otherwise place inside the comforter cover. Furthermore, once the comforter is inserted or otherwise placed inside the comforter cover, the comforter may be difficult to distribute evenly throughout the comforter cover. Still further, some comforter covers do not secure or stabilize the comforter within the comforter cover. In these cases, the comforter can move or shift within the comforter cover during use and become unevenly distributed. This unevenness can reduce the comfort provided and may adversely impact the usefulness of the comforter.

Many quilt covers are generally similar to comforter covers. A variety of quilt covers is known in the art. For example, U.S. Pat. No. 1,261,314 to Stoddard discloses a separate removable quilt covering comprising an upper cover and a lower cover considerably larger than the upper cover and the quilt to permit the outer edges to be folded over the top cover. Both covers are provided with buttonholes arranged along the edges and buttons are attached to the quilt to permit the cover sections to be secured thereto.

U.S. Pat. No. 1,577,226 to Greenberg discloses a comparable construction to Stoddard employing loops and straps as fastening members rather than buttons and buttonholes.

U.S. Pat. No. 2,183,360 to Sussman discloses a detachable cover for quilts comprising a casing. The casing has a transverse opening closed by flap. The quilt is apparently inserted through the opening into the casing. The quilt has buttons located, for example, at its corners which are engageable with buttonholes in the casing to connect the quilt and casing together and maintain their relative positions. Assembly of the quilt with the casing appears to lack ease and convenience. Further it appears doubtful whether this construction could be effectively employed with a bulky comforter.

The art also contains various proposals for comforter covers. For example, U.S. Pat. No. 7,181,790 to Wirtz discloses a single piece protective cover for a comforter having a bottom face and a top face forming a flexible woven fabric envelope. According to the description, the comforter can be placed on the bottom face of the comforter cover and covered with the top face of the cover. As described, zippers are employed to close the sides of the comforter cover. As acknowledged, in Wirtz's description (column 3, lines 26-28) the comforter can get caught in the zipper when the zipper is closed. Wirtz suggests a snag guard may be employed to overcome this problem, does not show one.

While the previously proposed comforter covers may be satisfactory for their intended purposes, they may not fulfill all desired purposes. Accordingly, there is a need for a new comforter cover which can serve additional purposes.

The foregoing description of background art may include insights, discoveries, understandings or disclosures, or associations together of disclosures, that were not known to the relevant art prior to the present invention but which were provided by the invention. Some such contributions of the invention may have been specifically pointed out herein, whereas other such contributions of the invention will be apparent from their context. Merely because a document may have been cited here, no admission is made that the field of the document, which may be quite different from that of the invention, is analogous to the field or fields of the present invention.

SUMMARY OF THE INVENTION

In one aspect, the invention provides a comforter cover for protecting a comforter which comprises a sleeve and an end cap. The sleeve can have an open end and the comforter can be received into the sleeve through the open end. The end cap can be fittable over the sleeve and comforter to close the open end of the sleeve. The comforter cover can comprise a fastening system to fasten the end cap to the sleeve.

Useful embodiments of the invention can provide effective dirt sealing in an esthetic manner as well as wear protection, stability of the comforter within the comforter cover and versatility of appearance. Also the invention provides a comforter cover which can be assembled with a comforter relatively easily and conveniently.

In one embodiment of the comforter cover of the invention, the sleeve has a second open end and the comforter cover comprises a second end cap to close the second open end of the sleeve. The second end cap can also be fittable over the sleeve and comforter, in this case to close the second open end of the sleeve. If desired, the comforter cover can comprises a fastening system to fasten the second end cap to the sleeve.

The fastening system can comprise at least one fastening member on each of the two end caps and the sleeve to fasten each end cap to the sleeve. The fastening system optionally can include at least one comforter fastening member on the comforter for which the comforter cover is intended, to fasten the comforter to the sleeve and to the end caps.

In some embodiments of the invention, the fastening system comprises multiple buttons attached to the comforter and buttonholes on the end caps and the sleeve, the buttonholes registering with the comforter buttons and wherein each button can button through one of the sleeve buttonholes and one of the end cap buttonholes.

The inventive comforter cover is versatile and can support a variety of ornamental effects. For example, the comforter cover can comprise multiple interchangeable end caps for replacement purposes or to provide different visual effects. The end caps can have different colors, tones, textures, fabrics, patterns, adornments or the like, for this purpose. If the fastening system comprises buttons, then the buttons can, if desired, be covered with a variety of button covers of various colors, tones, textures, fabrics, patterns, adornments or the like, which also will provide different visual effects.

The invention includes, a combination of the comforter cover with the comforter for which the comforter cover is intended, the comforter optionally including fastening members for attaching the comforter to the comforter cover.

BRIEF DESCRIPTION OF THE SEVERAL VIEWS OF THE DRAWING

Some embodiments of the invention, and of making and using the invention, as well as the best mode contemplated of carrying out the invention, are described in detail herein and, by way of example, with reference to the accompanying drawings, in which like reference characters designate like elements throughout the several views, and in which.

DETAILED DESCRIPTION OF THE INVENTION

Figure 1:
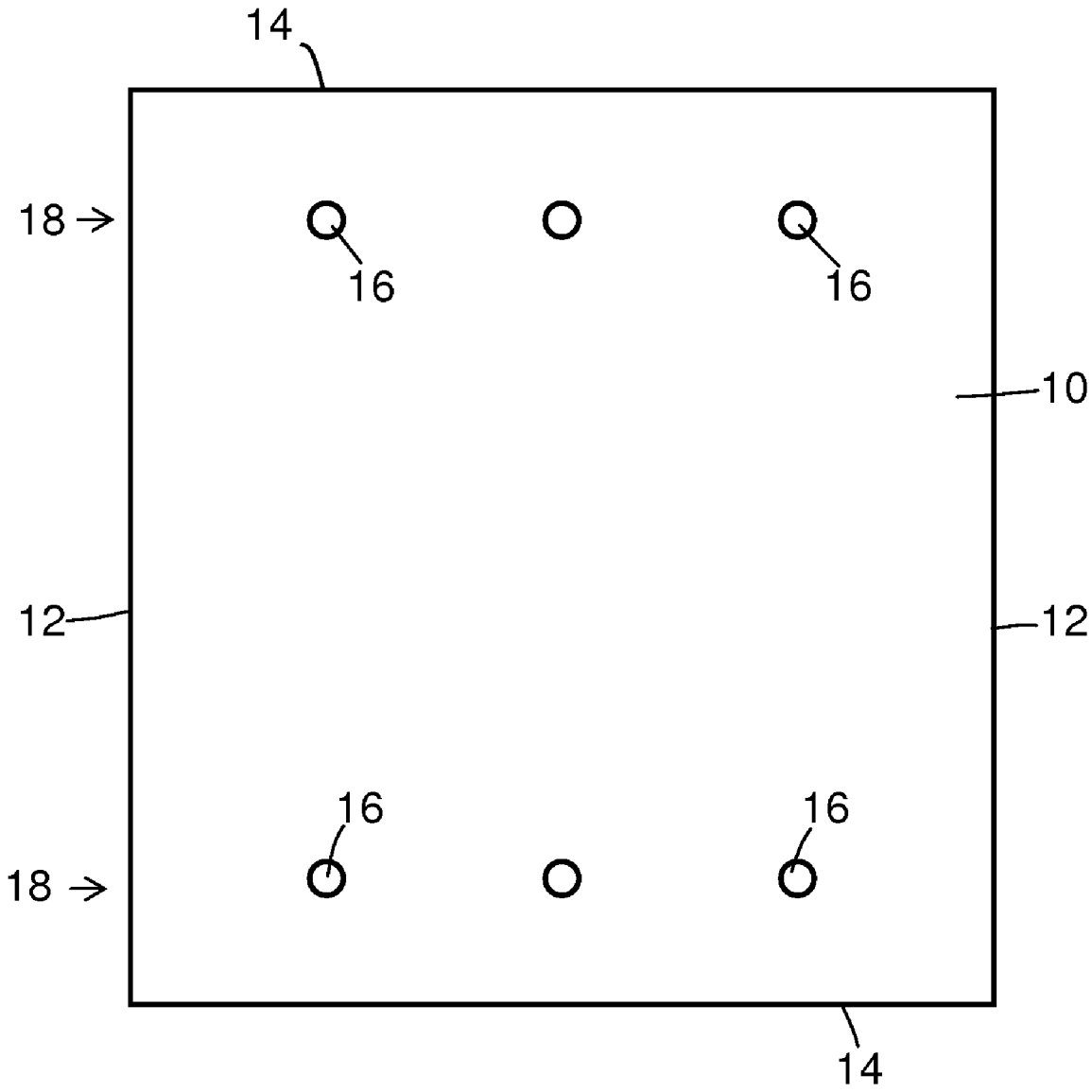
FIG. 1 is a top plan view of a comforter that can be covered by a comforter cover according to the invention.

Referring to the drawings, the comforter shown, referenced 10, is generally rectangular in the plan view shown having two longer sides 12 and two shorter ends 14. Comforter 10 can have a more or less substantial thickness, perpendicular to the view, as is known, or is further explained herein. Comforter 10 can have any of a wide variety of forms, constructions and purposes. Exemplary embodiments of comforter 10 are intended for insulating or ornamenting or both insulating and ornamenting a bed. Other embodiments of comforter 10 can serve other purposes, as will be, or will become, apparent to one skilled in the art, although other uses are possible some of which are described herein. If desired, a corresponding or different pattern of buttons 16 can also be provided on the (unseen) under surface of comforter 10.

As shown, comforter 10 is provided on its upper surface and under surface with a number of comforter fastening members, buttons 16 in the embodiment shown. Buttons 16 are components of a fastening system useful to fasten the comforter cover (to be described with reference to FIG. 2) to comforter 10. In FIG. 1, two rows 18 of three buttons 16 are shown arranged in a line across the width of comforter 10. The number of buttons 16 or other fasteners can depend upon the size of the comforter. The two rows 18 of buttons 16 are shown on the upper surface of the comforter and can also be present on the under surface of the comforter, if desired. Each row 18 of buttons 16 is positioned towards a respective one of the ends 14 of comforter 10. Rows 18 of buttons 16 can be positioned at a distance from the respective end 14 which is from about 5 to about 33 percent of the length of comforter 10, or in other suitable location. Buttons 16 can be either permanently mounted on comforter 10 or detachably attached thereto. As an alternative to, or in addition to buttons 16, other suitable fasteners can be used to secure the comforter to the comforter cover, some of which are described herein The arrangement and disposition of buttons 16 can be selected for effective attachment of comforter 10 to the comforter cover and also for ornamental and other purposes. One or two, or more, additional rows 18 of fasteners 16 can be provided, if desired. Other arrangements of fasteners 16 can be employed as will be or become apparent to person of ordinary skill in the art, some of which other arrangements are described herein.

Also in FIG. 1, three buttons 16 are shown in each row 18. This number provides a balance between ease of use and effective fastening. Other numbers of buttons 16, or other suitable fastening members, can be employed in each row, if desired, for example, two, four or five or another suitable number between one and about 10. Different rows 18 can contain the same or different numbers of buttons 16 or other fastening members.

The particular buttons 16 depicted are circular buttons. However, other button or fastener shapes can be employed, if desired, for example oval or square or another suitable shape. Buttons 16 can be formed of plastic, wood, leather, fabric, or any other suitable material and can be fabric covered, if desired, for example to match the outer fabric of comforter 10 or to match the sleeve or end caps of the comforter cover.

If desired, buttons 16 or other suitable fasteners, for example hook-and-loop fasteners, snap fasteners or the like, can be supplied for attachment to an existing comforter. Also, a fastener attachment device can be included, for example sewing thread, adhesive, clips, pins or other suitable materials or structures. For example, buttons 16 can be supplied with suitable thread and, optionally, a needle and instructions, allowing them to be sewn on to an existing comforter. The buttons, with or without attachment material, or other fasteners or fastening system can be supplied along with comforter 10 or comforter cover 20 as a kit, or the like, intended to cover an existing comforter of a particular size and/or style.

Figure 2:
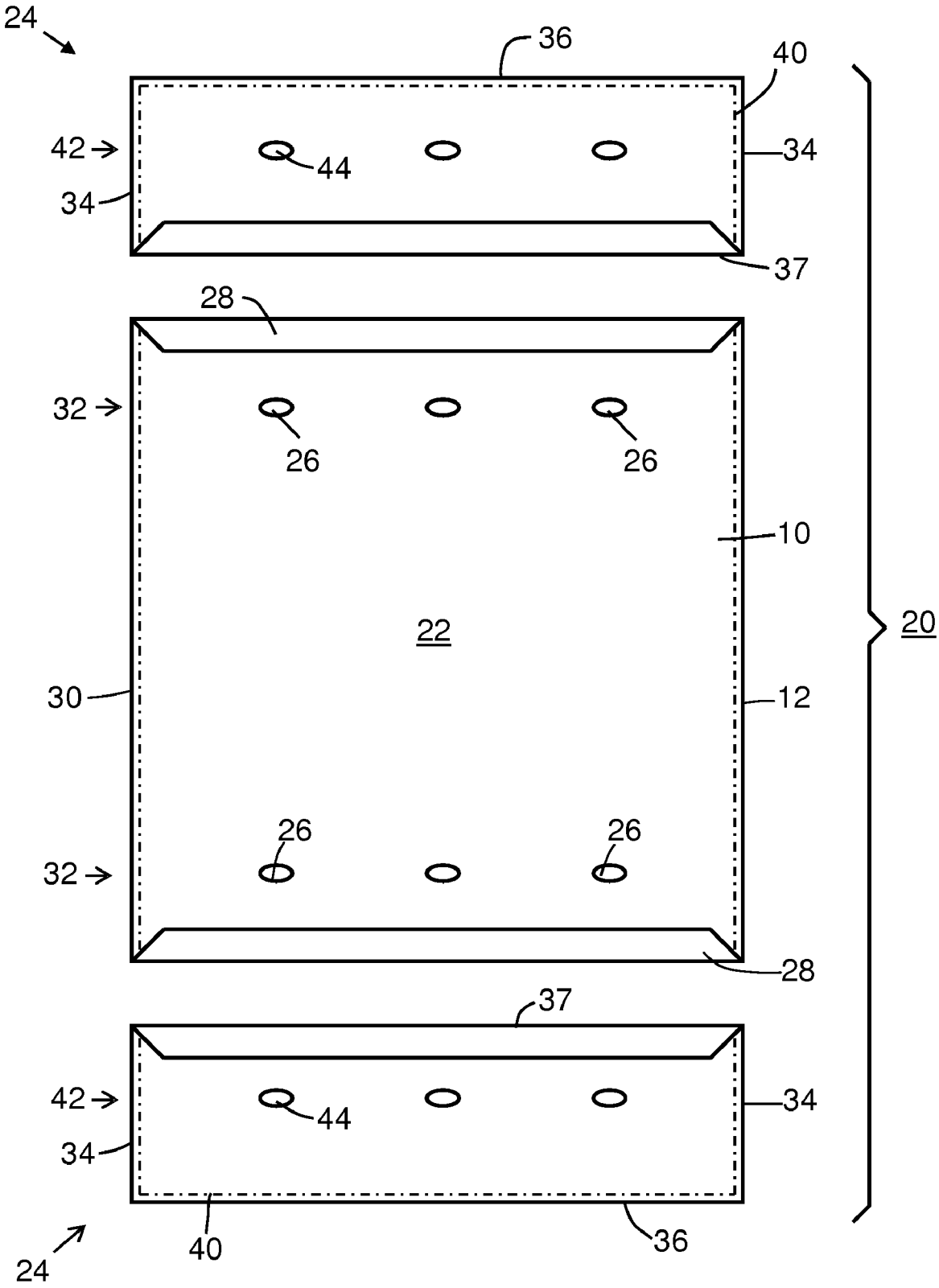
FIG. 2 is a top plan view of one embodiment of comforter cover according to the invention which can be employed for covering a comforter such as that shown in FIG. 1.
Figure 3:
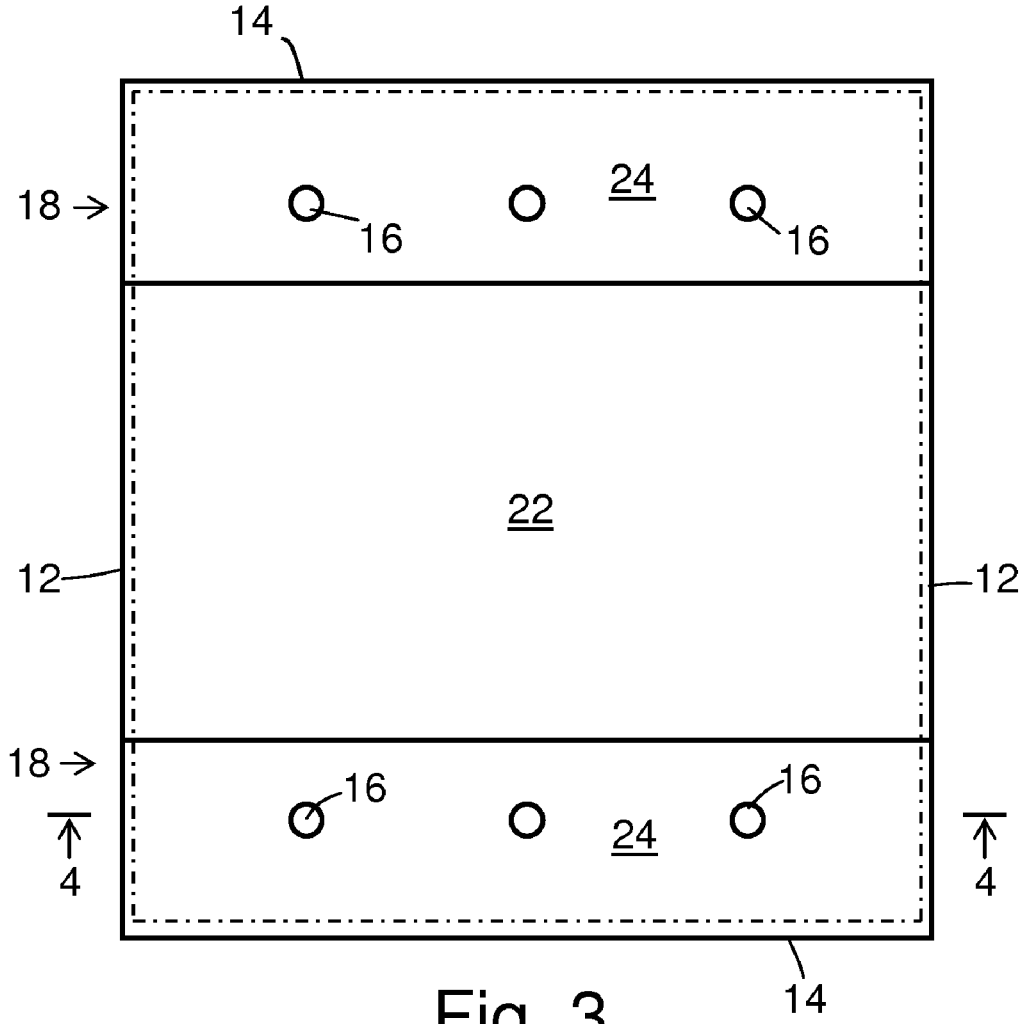
FIG. 3 is a plan view of the comforter cover shown in FIG. 2 fitted to the comforter shown in FIG. 2.
Figure 4:
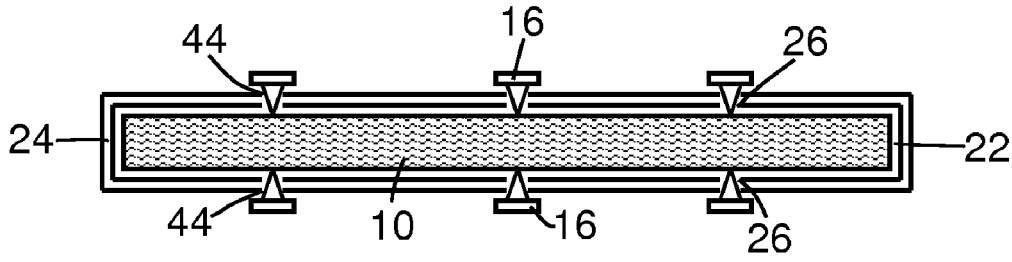
FIG. 4 is a section on the line 4-4 of FIG. 3.

Referring now to FIG. 2, the comforter cover shown, referenced 20, is designed to fit comforter 10 and comprises a sleeve 22, two end caps 24 and fastening members in the form of buttonholes 26 and 44.

Sleeve 22 is intended to receive and cover comforter 10 and has two open ends 28 through either of which comforter 10 can be received. The sleeve 22 shown is rectangular and can be dimensioned to be a more or less close fit around comforter 10. Desirably, the size and shape of sleeve 22 are selected to closely fit comforter 10, although variation from a close fit is possible. Longitudinally, sleeve 22, in one embodiment of the invention, is approximately the same length as comforter 10. In other embodiments of the invention, sleeve 22 is respectively longer than, or shorter than comforter 10. Sleeve 22 can be made from two pieces of fabric joined by stitching 30 (shown schematically) extending the full length of both long sides 12 of sleeve 22. Alternatively, sleeve 22 can be made from a single piece of fabric with stitching 30 along one side only of sleeve 22 (not shown).

In the embodiment shown, sleeve 22 comprises two rows 32 of buttonholes 26, there being three buttonholes 26 in each row 32. Buttonholes 26 also are components of the comforter cover fastening system and are constructed to cooperate with buttons 16 to effectively fasten sleeve 22 to comforter 10. Desirably multiple buttonholes 26 are positioned to register with some or all buttons 16 on comforter 10, when comforter 10 is suitably positioned in sleeve 22, so that buttons 16 can be secured in respective ones of buttonholes 26, holding sleeve 22 in place on comforter 10. If desired some buttons 16 or buttonholes 26 can lack a cooperative fastening member. In one embodiment of the invention all buttons 16 can register with a buttonhole 26 and there are no unmatched buttonholes 26. Usefully, some or all of buttons 16, and buttonholes 26, can be located in end zones of comforter 10, or sleeve 22, where they will be covered by one or the other end cap 24 when end caps 24 are assembled with comforter 10 and sleeve 22.

Each end cap 24 can close an open end 28 of sleeve 22. For this purpose, each end cap 24 can be configured and dimensioned to fit over sleeve 22 when assembled with comforter 10. Desirably, each end cap 24 entirely covers and closes a respective open end 28 of sleeve 22 when fitted over sleeve 22 and comforter 10. It also is desirable for each end cap 24 to extend along the length of sleeve 22 and comforter 10 a sufficient distance that it does not unintentionally remove itself from the sleeve and comforter and provides an effective and esthetic seal against dust and dirt.

End caps 24 can have any suitable shape and as shown can each be rectangular having two short sides 34 and two long sides 36, 37. Short sides 34 and long side 36 are closed while long side 37 is left open. Thus, each end cap 24 can fit over sleeve 22 and comforter 10, receiving them through open long side 37, so that its short sides 34 extend along the length of the sleeve and the comforter and its closed long side 36 fits against the end 28 of sleeve 22 and the end 14 of comforter 10. By way of example, one or both end caps 24 can have a short side dimension which from about 5 to about 33 percent of the length of comforter 10.

One or both end caps 24 can comprise a pair of fabric panels that are joined together by stitching 40, or other suitable measures, along the two short sides 34 and long side 36. Alternatively, one or both end caps 24 can comprise a single fabric panel folded over and joined by stitching along only the two short sides 34. Other suitable constructions of end caps 24 will be, or become, apparent to those skilled in the art. Open long side 37 can be a straight edge as shown or can have a more or less complex shape, if desired, for example, semicircular, sinuous or scalloped. End caps 24 can be the same as, or different from, one another.

Each end cap 24 can also be provided with one or more fastening members cooperative with fastening members on comforter 10 or sleeve 22. As shown, each end cap 24 is provided with a row 42 of three buttonholes 44. The number, style and function of buttonholes 44 can be varied in a similar way to the variations described for buttonholes 26 on sleeve 22. Buttonholes 44 also can be components of the comforter cover fastening system. Buttonholes 44 can be manipulated to fasten each end cap 24 to buttons 16 projecting through buttonholes 26 in sleeve 22 to secure each end cap 24 to comforter 10 and sleeve 22. Desirably, buttons 16 and buttonholes 44 are constructed and positioned to hold each end cap in place with a desired disposition and to resist displacement of the end cap.

In one embodiment of the invention (not shown), end caps 24 can be provided with ornamental nonfunctional buttons complementing or contrasting with buttons 16 which will button through sleeve 22 and end caps 24. For example a row of five buttons can comprise three functional buttons 16 and two nonfunctional, ornamental buttons. Various patterns of buttons can be employed, if desired, for example, zig-zag or diamond shaped or other desired pattern employing functional buttons 16 with or without additional buttons intended solely for ornamentation.

If desired end caps 24 can be buttoned directly to comforter 10, without using sleeve 22. Also if desired, sleeve 22 and one or both end caps 24 can be provided with mutually cooperative fastening members so that one or both end caps 24 can be fastened to sleeve 22. Such fastening of end caps 24 to sleeve 22 can be alternative to, or additional to, structures permitting an end cap to be fastened to comforter 10.

Another embodiment of the invention employs a comforter cover 20 having a single open end and a single end cap 24. This embodiment can effectively fasten the single end cap 24 with only a single row 18 of fastening members, although more fastening members can be employed, if desired.

Comforter 10 can have any desired dimensions. For example, comforter 10 can be dimensioned to fit a standard size of bed such as: a twin bed for which some exemplary dimensions comprise a width of about 1.70 m (about 68 inches) and a length of about 2.2 m (about 88-inches); a double bed for which some exemplary dimensions comprise a width of about 2.1 m (about 84 inches) and a length of about 2.2 m (about 88 inches); a queen bed for which some exemplary dimensions comprise a width of about 2.2 m (about 88 inches) and a length of about 2.5 m (about 100 inches); a king bed for which some exemplary dimensions comprise a width of about 2.55 m (about 102 inches) and a length of about 2.5 m (about 100 inches); or a California king for which some exemplary dimensions comprise a width of about 2.75 m (about 110 inches) and a length of about 2.5 m (about 100 inches). Sleeve 22 of comforter cover 20 desirably is dimensioned to be a close fit to comforter 10, but can be a more or less loose fit, if desired. Similarly, end caps 24 desirably are dimensioned to be a close fit to comforter 10 and sleeve 22, but can be a more or less loose fit, if desired.

In use comforter cover 20 is assembled with comforter 10 by first inserting comforter 10 into sleeve 22 and then assembling end caps 24 over the ends 14 of comforter 10 and the open ends 28 of sleeve 22. Comforter 10 can relatively easily be inserted into sleeve 22, by folding it, pulling it, sliding it or rolling it to insert it, if desired, and then unfolding or unrolling it within sleeve 22 if desired. Because one can access both ends, comforter 10 usually will not bunch up or shift during the insertion process. Once within sleeve 22, comforter 10 is positioned to align the respective cooperative fastening members provided on comforter 10 and comforter cover 20, in embodiment shown in the drawings, buttons 16 and buttonholes 26, and these are then fastened together. These assembly operations can usually be accomplished relatively easily and conveniently.

Manipulation of comforter 10 within sleeve 22 and alignment and fastening of the fastening members are all facilitated by embodiments of the invention wherein sleeve 22 is open at both ends, providing access to comforter 10 within sleeve 22 from two directions. In contrast, conventional comforter covers that are open on only one side can be difficult to assemble with their comforters, especially with larger comforters. Specifically, it can be difficult to manipulate the corners of the comforter inside the cover to fit into the corners of the comforter cover remote from the open side of the cover. Use of a comforter cover embodying the invention which comprises a sleeve such as sleeve 22, which is open at both ends, can solve this problem.

With sleeve 22 and comforter 10 properly assembled, each end cap 24 in turn can be fitted by opening it up, if necessary, and pulling the end cap over the ends of sleeve 22 and comforter 10. When end cap 24 is snugly and properly fitted, the fastening members on the end cap, for example the illustrated buttonholes 44, will align with the cooperative fastening members on comforter 10 or sleeve 22, for example buttons 16, so that they can easily be fastened together.

Each end cap 24 can cover open end 28 of sleeve 22 and protect comforter 10 from ingress of dust or dirt. End caps 24 can also protect comforter 10, and sleeve 22 from wear and tear. One or both primary end caps 24 can be replaced when worn with replacement end caps 24, if desired, for less cost than replacing comforter 10 or a conventional comforter cover. Replacement end caps 24 can have a different appearance from the primary end caps employed, giving the covered comforter a new appearance when they are fitted, for example, as is further described herein. Replacement end caps 24 can be employed at any desired time, regardless of whether the primary end caps are worn, and, unlike a full comforter cover, require little storage space when not in use.

If desired, end caps 24 can be buttoned, or otherwise fastened, directly to comforter 10, without utilizing sleeve 22. The inventions includes an embodiment wherein end caps 24 are sufficiently long to meet, or overlap, in the middle of comforter 10. If desired, such elongated end caps 24 can be provided with cooperative fastening members to fasten end caps 24 to each other.

Comforter 10 can have a wide variety of forms and can, for example, comprise a fabric envelope of cotton, polyester or other suitable material, filled or stuffed with a natural or synthetic insulating material, for example down, feathers, polyurethane foam or the like. Comforter 10 can comprise a quilt, a puff, a duvet, an eiderdown stuffed with down or feathers from the eider duck, other feathers or another suitable filling, or other comparable product. Comforter 10 can provide an insulating covering for a bed, divan, couch or can serve any other desired purpose.

Sleeve 22 and end caps 24 can be made of any desired fabric or other suitable material, for example a porous, breathable, flexible material such as a cotton, cotton blend, polyester, polyolefin, nylon or other suitable fabric. Sleeve 22 and end caps 24 can be fabricated from the same fabric in the same colors as each other, can have different colors, or can be fabricated from different fabrics from each other. Sleeve 22 and end caps 24 can have a similar appearance to comforter 10 and can be made of similar fabric in a similar color to comforter 10, if desired, so as to closely match comforter 10. Alternatively, sleeve 22 end caps 24 can be different from comforter 10. If desired, sleeve 22 and end caps 24 can have a gossamer or netlike appearance permitting the appearance of comforter 10 to be perceived through comforter cover 20. In addition, the buttons or other cooperative fastening members may be covered with a fabric to further alter the appearance of comforter cover 20.

In one embodiment of the invention, buttons or other cooperative fastening members are mounted on sleeve 22 and end caps 24 so that end caps 24 can be assembled around a sleeve-covered comforter 10 and fastened to sleeve 22 to be secured in place relative to sleeve 22 and the cooperative fastening system employed to secure comforter cover 20 to comforter 10 is omitted. Employing a comforter cover 20 which is a reasonably close fit to comforter 10 this system can be satisfactory for some comforters. It is desired, however, to control movement of comforter 10 within comforter cover 20, then means can be provided for relative attachment of the one product to the other, for example, as described above. This control of movement can stabilize the comforter in the comforter cover and secure the comforter in place.

It will be understood that while some described embodiments of the invention employ structural members such as buttons 16 and buttonholes 26 to fasten comforter cover 20 to comforter 10, the invention also includes embodiments wherein such fastening members are omitted. As suggested above, the invention also includes embodiments wherein other cooperative fastening members are employed in place of buttons 16 and buttonholes 26, for example a strip or strips of hook-and-loop fasteners; loops and straps, snap fasteners, slide fasteners, corner fasteners or grips, cufflink-style fasteners, ties or the like. Similarly button holes 44 can be omitted from end caps 24, if desired, and end caps 24 can be retained in place by other suitable fastening members, for example cooperative pairs of fastening members provided respectively on end caps 24 and sleeve 22. Alternatively, the fastening members may comprise cooperative frictional surfaces on the end caps 24 and sleeve 22, suitable friction optionally being provided by appropriate selection of the materials of end caps 24 and sleeve 22. In one embodiment of the invention, at least one material with a directional nap is employed and the direction of the nap is selected to urge the end cap and sleeve in a closing direction rather than an opening direction.

If desired, blind fasteners can be employed, located out-of-sight for example under an edge of open end 28 of one or both end caps 24. In one embodiment of the invention, blind fasteners are employed to "invisibly" secure end caps 24 to sleeve 22 and buttonholes 44 are omitted from end caps 24, providing a plain unadorned appearance to comforter cover 20. In this embodiment, buttons 16 on comforter 10 can be flat, or other low profile fasteners can be used, so as to provide minimal interruption of the continuous appearances of end caps 24.

Figure 5:
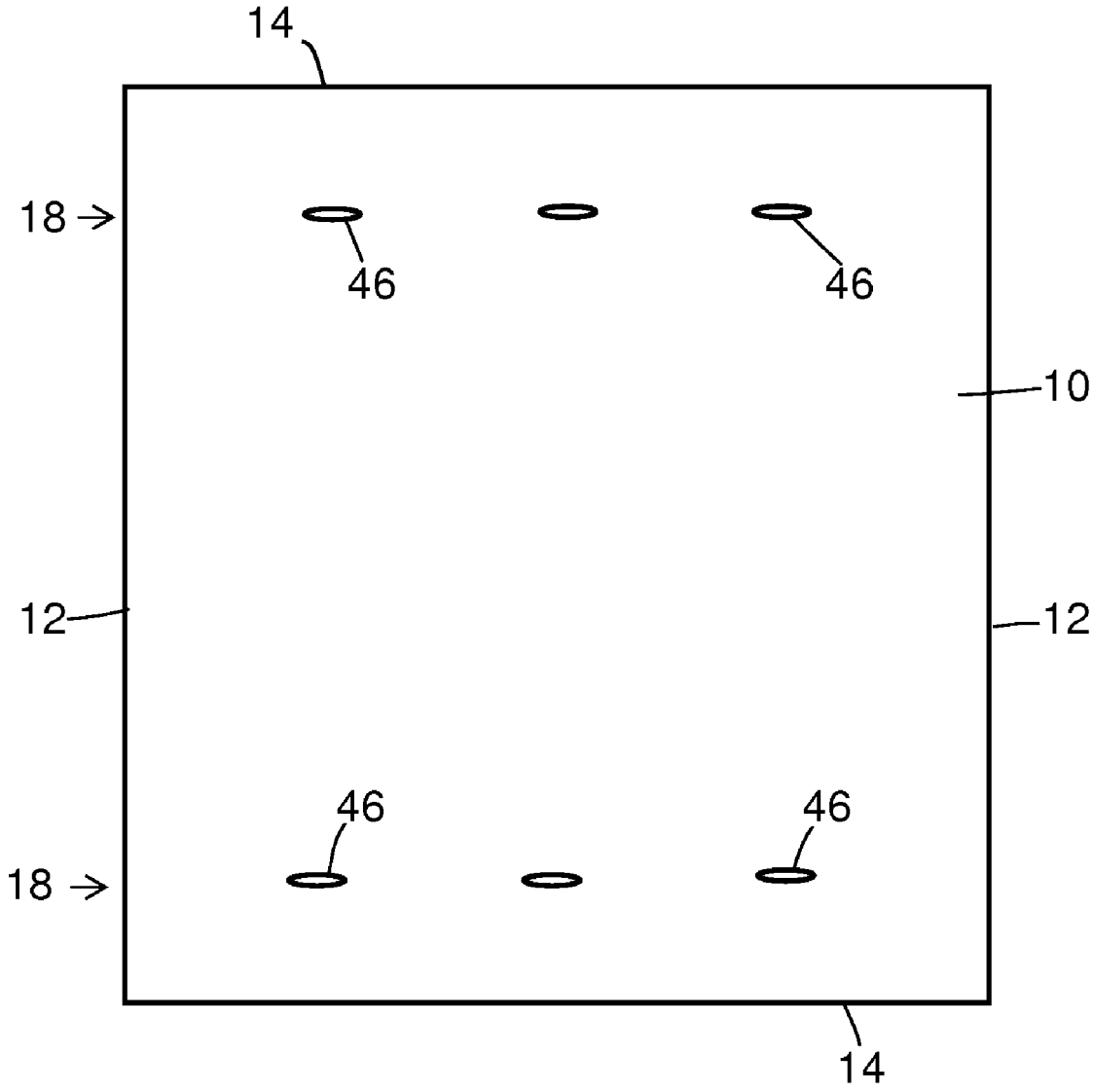
FIG. 5 is a top plan view of a modified comforter being a further embodiment of the invention.
Figure 6:
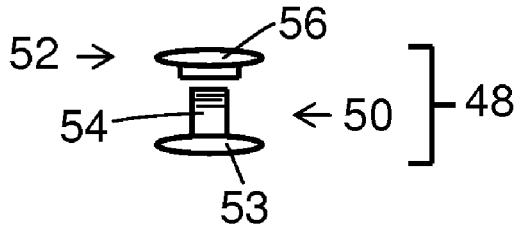
FIG. 6 is a front view of a cufflink-style fastening device useful with the comforter shown in FIG. 5.

As shown in FIGS. 5 and 6, in further embodiments of the invention, the fastening system can comprise multiple holes 46 in comforter 10 (FIG. 5) and corresponding with buttonholes 26 and 44, or other suitable holes in end caps 24 and sleeve 22. The various holes are sized and positioned to register with each other when comforter 10, sleeve 22 and end caps 24 are suitably aligned. If desired, holes 46 can be fabricated in comforter 10 during manufacture. Alternatively, they can be fabricated in an existing comforter by an end user or a technician, by cutting and sewing, cutting and riveting or sealing, or by another suitable method.

FIG. 6 illustrates a closable cufflink-style fastening device which can be inserted through the aligned holes in comforter 10, end caps 24 and sleeve 22 to secure comforter 10 to end caps 24 and sleeve 22. In some embodiment of the cuff-link type fastening device, closable fastening device 48 has two parts 50 and 52. The first part 50 of closable fastening device 48 has a flat bottom 53 and a long shaft 54 that is long enough to pass through the comforter, the end caps and the sleeve, and has a threaded tip. The second part 52 of closable fastening device 48 has a flat top 56 that screws or otherwise attaches to first part 50 of closable fastening device 48. Closable fastening device 48 can have any desired appearance, ornamental or otherwise and can coordinate with or contrast with the appearance of comforter cover 20.

First part 50 of closable fastening device 48 can be inserted through one layer of an end cap 24, through one layer of sleeve 22 and through comforter 10, when these components are suitably aligned, and then through the second layer of sleeve 22 and the second layer of the respective end cap 24. Second part 52 of closable fastening device 48 can then be screwed, or otherwise secured or fastened to the first part 50 of closable fastening device 48. A set of four, six or other suitable number of closable fastening devices 48 is supplied and when a desired number is fastened as described, comforter 10 will be securely fixed to end caps 24 and sleeve 22 comprising comforter cover 20.

End caps 24 can take any of a wide variety of forms and may be substantially identical to one another, generally similar or distinctly different, one from the other.

They can have appearances which coordinating one with another and/or with the appearance of sleeve 22. Alternatively, they can have appearances which contrast one with another and/or with the appearance of sleeve 22. For example, comforter cover 20, comprising sleeve 22 as well as end caps 24, can be provided in different colors, with different patterns or with different visual scenes according to the seasons.

If desired a coordinated set of four pairs of end caps 24 or complete comforter covers 20 can be provided, each having a different appearance, one for each season. Other numbers of end caps 24 can be included in sets for this or other purposes as will be or become apparent to a person of ordinary skill in the art. Because end caps 24 require a much lesser amount of material than does a full comforter cover, multiple end caps 24 can be economically supplied for a variety of ornamental, replacement or other purposes.

In an embodiment of the invention intended to appeal to children, one end cap can have the appearance of the head or upper part of a person or animal and the other end cap 24 can have the appearance of the legs or lower part of the person or animal. Multiple end caps 24 in variations of the respective upper or lower part can provide a number of combinations from which to choose. Sleeve 22 can have a middle body appearance in the area between the two end caps 24, when assembled, that generically coordinates with the various end cap appearances.

If desired, the appearance of comforter cover 20 can be coordinated or contrasted with the appearance of comforter 10.

Some embodiments of the invention comprise a comforter 10 in combination with, for example packaged with, or supplied in association with comforter cover 20, for example in a variety of colors or forms whereby comforter cover 20 can be "mixed-and-matched" with comforter 10.

Disclosures Incorporated. The entire disclosure of each and every United States patent and patent application, each foreign and international patent publication, of each other publication and of each unpublished patent application that is specifically referenced in this specification is hereby incorporated by reference herein, in its entirety.

The foregoing detailed description is to be read in light of and in combination with the preceding background and invention summary descriptions wherein partial or complete information regarding the best mode of practicing the invention, or regarding modifications, alternatives or useful embodiments of the invention may also be set forth or suggested, as will be apparent to one skilled in the art. Should there appear to be conflict between the meaning of a term as used in the written description of the invention in this specification and the usage in material incorporated by reference from another document, the meaning as used herein is intended to prevail.

While illustrative embodiments of the invention have been described above, it is, of course, understood that many and various modifications will be apparent to those of ordinary skill in the relevant art, or may become apparent as the art develops, in the light of the foregoing description. Such modifications are contemplated as being within the spirit and scope of the invention or inventions disclosed in this specification.

The invention claimed is:

1. A comforter cover for protecting a comforter, the comforter cover comprising:

(a) a sleeve having a first and a second open ends, the comforter being receivable into the sleeve through the first open end;

(b) a separately made first end cap fittable over the sleeve and the comforter to close the first open end of the sleeve;

(c) a first fastening system to fasten the first end cap to the sleeve and to the comforter;

(d) a separately made second end cap fittable over the sleeve and the comforter to close the second open end of the sleeve;

(e) wherein the comforter being aligned in the sleeve through the second open end; and (f) a second fastening system to fasten the second end cap to the sleeve and to the comforter.

2. A comforter cover according to claim 1 wherein the first and the second fastening systems comprises a first comforter fastening member on each of the two end caps, a second comforter fastening member on the sleeve, and a third comforter fastening member on the comforter to fasten each end cap to the sleeve, and to fasten each end cap and the sleeve to the comforter.

3. A comforter cover according to claim 1 wherein the at least one fastening systems comprises at least one comforter fastening member on the comforter to fasten the comforter to the comforter cover.

4. A comforter cover according to claim 1 wherein the at least one fastening system comprises cooperative fastening members selected from the group consisting of: buttons and buttonholes; hook-and-loop fasteners; cufflink-style fasteners; loops and straps; snap fasteners; slide fasteners; corner fasteners; grips; and ties.

5. A comforter cover according to claim 1 wherein the at least one fastening system comprises multiple buttons attached to the comforter and buttonholes on the end cap and the sleeve, the buttonholes being registrable with the comforter buttons and wherein each button can button through one of the sleeve buttonholes and one of the end cap buttonholes.

6. A comforter cover according to claim 1 wherein the sleeve has a rectangular shape and is sized to closely fit the comforter, each short side of the sleeve being open to provide an open end to insert and to align the comforter and wherein the first and the second end caps are rectangular and have an opening along one long side, the comforter and sleeve being receivable into the first and the second end caps through the opening in the first and the second end caps, wherein a short side of the first and the second end cap has a length of from about 5 percent to about 33 percent of the length of the sleeve, and wherein the first and the second end caps are sized to closely fit the sleeve and comforter.

7. A comforter cover according to claim 1 wherein the comforter cover includes fastening members intended for attachment to the comforter.

8. A comforter cover according to claim 7 wherein the fasteners to be attached to the comforter comprise buttons, hook or loop fasteners, cufflink-style fasteners or snap members and the comforter cover includes a fastener attachment device, optionally sewing thread, adhesive, clips or pins.

9. A comforter cover according to claim 1 wherein the comforter cover comprises multiple interchangeable end caps providing different visual effects.

10. A comforter cover according to claim 1 wherein the fastening system comprises multiple holes in the comforter, holes in the end caps and the sleeve and at least one closable fastener, the holes in the end caps and the sleeve being registrable with the comforter holes and wherein the closable fastener can pass through the holes in the end cap, the sleeve and the comforter and secure the end caps and sleeve to the comforter.

11. A comforter cover according to claim 1 in combination with a comforter to be covered by the comforter cover, the comforter optionally including fastening members for attaching the comforter to the comforter cover.

12. A comforter cover for protecting a comforter, the comforter cover comprising:

(a) a sleeve having an open end, the comforter being receivable into the sleeve through the open end;

(b) a separately made end cap fittable over the sleeve and the comforter to close the open end of the sleeve;

(c) a fastening system to fasten the end cap to the sleeve and to the comforter.

13. A comforter cover according to claim 12 wherein the fastening system comprises a first comforter fastening member on the end cap, a second comforter fastening member on the sleeve, and a third comforter fastening member on the comforter to fasten the end cap to the sleeve, and to fasten the end cap and the sleeve to the comforter.

14. A comforter cover according to claim 12 wherein the fastening system comprises at least one comforter fastening member on the comforter to fasten the comforter to the comforter cover.

15. A comforter cover according to claim 12 wherein the fastening system comprises cooperative fastening members selected from the group consisting of: buttons and buttonholes; hook-and-loop fasteners; cufflink-style fasteners; loops and straps; snap fasteners; slide fasteners; corner fasteners; grips and ties.

16. A comforter cover according to claim 12 wherein the fastening system comprises multiple buttons attached to the comforter and buttonholes on the end caps and the sleeve, the buttonholes being registrable with the comforter buttons and wherein each button can button through one of the sleeve buttonholes and one of the end cap buttonholes.

17. A comforter cover according to claim 12 wherein the sleeve has a rectangular shape and is sized to closely fit the comforter, a short side of the sleeve being open to provide an open end to insert and to align the comforter and wherein the end cap is rectangular and has an opening along one long side, the comforter and sleeve being receivable into the end cap through the end cap opening, wherein a short side of the end cap has a length of from about 5 percent to about 33 percent of the length of the sleeve, and wherein the end cap is sized to closely fit the sleeve and comforter.

18. A comforter cover according to claim 12 wherein the comforter cover includes fastening members intended for attachment to the comforter.

19. A comforter cover according to claim 18 wherein the fasteners to be attached to the comforter comprise buttons, hook or loop fasteners, cufflink-style fasteners or snap members and the comforter cover includes a fastener attachment device, optionally sewing thread, adhesive, clips or pins.

20. A comforter cover according to claim 12 wherein the comforter cover comprises multiple interchangeable end caps providing different visual effects.

21. A comforter cover according to claim 12 wherein the fastening system comprises multiple holes in the comforter, holes in the end caps and the sleeve and at least one closable fastener, the holes in the end caps and the sleeve being registrable with the comforter holes and wherein the closable fastener can pass through the holes in the end cap, the sleeve and the comforter and secure the end caps and sleeve to the comforter.

22. A comforter cover according to claim 12 in combination with a comforter to be covered by the comforter cover, the comforter optionally including fastening members for attaching the comforter to the comforter cover.

* * * * *